US008568242B2

(12) United States Patent
Milligan

(10) Patent No.: US 8,568,242 B2
(45) Date of Patent: Oct. 29, 2013

(54) EXPANDABLE BATON FOR SELF-DEFENSE TRAINING

(76) Inventor: Clive Milligan, British Columbia (CA)

( * ) Notice: Subject to any disclaimer, the term of this patent is extended or adjusted under 35 U.S.C. 154(b) by 117 days.

(21) Appl. No.: 13/265,128

(22) PCT Filed: Apr. 20, 2010

(86) PCT No.: PCT/CA2010/000617

§ 371 (c)(1),
(2), (4) Date: Jan. 6, 2012

(87) PCT Pub. No.: WO2010/121378

PCT Pub. Date: Oct. 28, 2010

(65) Prior Publication Data

US 2012/0129613 A1 May 24, 2012

Related U.S. Application Data

(60) Provisional application No. 61/170,780, filed on Apr. 20, 2009.

(51) Int. Cl.
*F41B 15/02* (2006.01)

(52) U.S. Cl.
USPC ..... 463/47.7

(58) Field of Classification Search
USPC ..... 463/47.2, 47.7
See application file for complete search history.

(56) References Cited

U.S. PATENT DOCUMENTS

| | | | | |
|---|---|---|---|---|
| 4,135,719 | A * | 1/1979 | Braunhut | 463/47.7 |
| 4,456,255 | A * | 6/1984 | Braunhut | 463/47.7 |
| 4,687,131 | A * | 8/1987 | von Braunhut | 231/2.1 |
| 5,031,827 | A * | 7/1991 | von Braunhut | 231/3 |
| 5,356,139 | A | 10/1994 | Parsons | |
| 5,372,363 | A * | 12/1994 | Siddle | 463/47.7 |
| 5,407,197 | A | 4/1995 | Parsons | |
| 5,509,653 | A | 4/1996 | Parsons | |
| 5,568,922 | A | 10/1996 | Siddle | |
| 5,630,998 | A | 5/1997 | Parsons | |
| 5,657,986 | A | 8/1997 | Parsons | |
| 5,690,552 | A * | 11/1997 | Siddle | 463/47.7 |
| 5,868,621 | A | 2/1999 | Parsons | |
| 6,135,888 | A | 10/2000 | Hindi | |
| D440,273 | S | 4/2001 | Hindi | |
| 7,044,858 | B1 | 5/2006 | Otto et al. | |
| 7,416,490 | B2 | 8/2008 | Parsons et al. | |

FOREIGN PATENT DOCUMENTS

CA 2061540 4/1994

(Continued)

OTHER PUBLICATIONS

International Preliminary Report on Patentability, PCT/CA2010/000617, dated Oct. 25, 2011, 4 pages.

*Primary Examiner* — William Pierce

(74) *Attorney, Agent, or Firm* — Klarquist Sparkman, LLP

(57) ABSTRACT

An expandable baton for use in self-defense training, comprising a plurality of sections including a handle and an end section, the plurality of sections adapted to nest within the handle section in a collapsed state. A magnet centrally mounted in an end cap engage a metal member in the end section to maintain the collapsed state until expansion is desired. When the expandable baton is extended, the handle section, middle section and the end section are frictionally engaged in an extended configuration.

12 Claims, 8 Drawing Sheets

(56) References Cited

FOREIGN PATENT DOCUMENTS

| | | |
|---|---|---|
| CA | 2067030 | 4/1994 |
| CA | 2145285 | 7/1994 |
| CA | 2059339 | 9/1997 |
| EP | 0680595 | 11/1995 |
| EP | 0780657 | 6/1997 |

* cited by examiner

EXPANDABLE BATON FOR SELF-DEFENSE TRAINING

CROSS-REFERENCE TO RELATED APPLICATIONS

This is a National Stage of International Application No. PCT/CA2010/000617, filed Apr. 20, 2010, which claims priority to U.S. Provisional Application No. 61/170,780, filed Apr. 20, 2009, both of which are incorporated herein by reference.

FIELD OF INVENTION

The present invention relates to an expandable baton for use in self-defense training.

BACKGROUND OF THE INVENTION

Various types of batons are used for self defense in law enforcement. Configurations include straight 'nightsticks', or those modified with a side handle that may be carried in a holster on the hip or leg; more recently developed designs may be telescoping or expandable, allowing the baton to be carried in a holster on the belt, out of the way and not noticeable until it is needed.

Effective use of any self-defense apparatus, including batons, may require education of the user and use of realistic training scenarios (reality-based training). Reality-based training refers to an approach to self-defense training focusing on practical applications. Correct technique, proper tactics and use of the apparatus are taught in the context of a real situation, and the user handles the training apparatus in the same manner as the 'real' or service apparatus would be. Through repetition, such an approach may allow for the development of 'muscle memory', confidence and skill, and allow the user to react and perform appropriately, using the service apparatus effectively.

While ideally, the apparatus used in training would be identical to that used in a real situation, this may not be practical with weapons that deliver lethal, or less-lethal force. Use of non-lethal training ammunition (e.g. paint rounds) instead of live ammunition in a firearms training scenario is one adaptation. Use of a service baton in self-defense training, may inadvertently deliver sufficient force to cause injury or death if used on a training subject, even if they are protected by padding. Employing a 'striking bag' or other inanimate object (e.g. striking dummy) may remove most risk of injury associated with baton practice, but a striking bag cannot fight back, or respond to the user's actions or commands. A padded and trained role player may be the best practice to offer the user (the person being trained) realistic actions, threat cues, and human responses to strikes and tactics.

A training baton is disclosed in U.S. Pat. No. 5,630,998. This apparatus includes a flexible rod covered by a cushioning material and a removable (e.g. cloth) cover. Such a device may not fit into a holster used for most police batons and may necessitate a user placing the device in a pocket, through a loop or otherwise jury-rigging a means of carrying the device, that may not accurately reflect the user's normal practice for carrying a baton. When the user enters a training scenario, the act of locating and accessing the baton from the holster is not practiced, and thus important steps of the reality-based training is missed. The 'muscle memory' may not be developed and thus may not be available for a user to implement when faced with a real situation.

Patents by Siddle (U.S. Pat. Nos. 5,372,363, 5,568,922 and 5,690,552) disclose a telescoping baton and a method of making a telescoping baton by injection molding. These batons comprise a handle, middle and end section, with the end section being a metal rod. A magnet or metal clip in the handle end engages the metal end section to maintain the baton in a collapsed state. To expand such a device, a sharp swing of the handle in arc causes the metal rod to exert force so that the inner telescoping sections thrust outward under centrifugal force.

U.S. Pat. No. 5,509,653 to Parsons discloses an expandable baton with an end section having a removable tip. The tip may be magnetic, or have an 'o-ring' to aid in searching. A coupler for joining two batons to provide a riot control device, or riot baton is also disclosed.

U.S. Pat. Nos. 5,657,986, 5,868,621 and 5,356,139, also to Parsons, disclose an expandable baton comprising sections made of dissimilar materials. The handle and/or middle sections may be made of a lightweight material, while the tip section is a hardened steel material, placing the mass at the outer tip end of the baton to maintain the strike force capability of the baton.

U.S. Pat. No. 7,416,490, also to Parsons, discloses a collapsible service baton comprising a locking lug for maintaining the baton in an expanded configuration, which may be collapsed by a twisting motion (instead of applying force to the tip along the axis of the baton, by hitting the ground or a wall, for example).

U.S. Pat. No. 7,044,858 to Otto et al. discloses an expandable baton comprising a variable weight holding configuration adapted to retain at least one weight member inside the axial bore of the end section.

U.S. Pat. No. 6,135,888 to Hindi discloses a bulbous end cap ("Hindi Baton Cap™") for use with an expandable police baton.

Some expandable batons in the art appear to employ a magnet or clip to engage the metal rod of the end section to maintain a collapsed configuration. For batons having a second or middle section, this section may be restrained in the collapsed configuration by the tip or knob at the distal end of the end section.

An improved baton for self-defense training that is handled in the same, or effectively similar, manner as a service baton in field use is needed.

SUMMARY OF THE INVENTION

The present invention relates to an expandable baton for use in self-defense training. The baton comprises a plurality of sections including a handle and an end section, the plurality of sections adapted to nest within the handle section in a collapsed state. A magnet centrally mounted in an end cap engages a metal member in the end section, and in some embodiments, a second section, to maintain a collapsed state until expansion is desired. When the baton is extended, the handle section, second (or middle) section and the end section are frictionally locked in an extended configuration.

In an exemplary embodiment, the present invention relates to an expandable baton, comprising: a cylindrical handle section comprising a first end, a second end and an axial bore therethrough, and an end cap removably engaged with the first end of the handle section, the end cap comprising a centrally mounted magnet; a cylindrical middle-section comprising a third end and a fourth end, and an axial bore therethrough, and a first metal member located at the third end for engaging the centrally mounted magnet, and disposed within the axial bore of the cylindrical handle section, the middle section slidably engaged within the second end of the cylindrical handle section; an end-section comprising a fifth end and a sixth end, the end-section disposed within the axial bore of the middle-section, the end-section comprising a second metal member located at the fifth end for engaging the centrally mounted magnet; the end-section slideably engaged within the middle-section; wherein when the expandable baton is extended, the cylindrical handle section, the middle-section and the end section frictionally engage in an extended configuration, and wherein the handle section, middle section and end section comprise a lightweight, polymeric material.

In another exemplary embodiment, the present invention relates to an expandable baton, comprising: a cylindrical handle section comprising a first end, a second end and an axial bore therethrough, and an end cap removably engaged with the first end of the handle section, the end cap comprising a centrally mounted magnet; a cylindrical middle-section comprising an external surface, a third end and a fourth end, and an axial bore therethrough, the external surface of the third end having a greater diameter than the diameter of an internal surface of the axial bore of the handle section at the second end, a first metal member located at the third end for engaging the centrally mounted magnet, and disposed within the axial bore of the cylindrical handle section, the middle section slidably engaged within the second end of the cylindrical handle section; an end-section comprising a fifth end and a sixth end, the end-section disposed within the axial bore of the middle-section, the end-section comprising a second metal member located at the fifth end for engaging the centrally mounted magnet; the end-section slideably engaged within the middle-section; wherein when the expandable baton is extended, the cylindrical handle section, the middle-section and the end section frictionally engage in an extended configuration, and wherein the handle section, middle section and end section comprise a lightweight, polymeric material.

In another exemplary embodiment, the present invention relates to an expandable baton, comprising: a cylindrical handle section comprising a first end, a second end and an axial bore therethrough, and an end cap removably engaged with the first end of the handle section, the end cap comprising a centrally mounted magnet; a cylindrical middle-section comprising an external surface, a third end and a fourth end, and an axial bore therethrough, the external surface of the third end having a greater diameter than the diameter of an internal surface of the axial bore of the handle section at the second end, a first metal member located at the third end for engaging the centrally mounted magnet, and disposed within the axial bore of the cylindrical handle section, the middle section slidably engaged within the second end of the cylindrical handle section; an end-section comprising an external surface, a fifth end and a sixth end, the external surface of the fifth end having a greater diameter than the diameter of an internal surface of the axial bore of the middle section at the second end, the end-section disposed within the axial bore of the middle-section, the end-section comprising a second metal member located at the fifth end for engaging the centrally mounted magnet; the end-section slideably engaged within the middle-section; wherein when the expandable baton is extended, the cylindrical handle section, the middle-section and the end section frictionally engage in an extended configuration, and wherein the handle section, middle section and end section comprise a lightweight, polymeric material.

In another exemplary embodiment, the handle section, end cap, second section and end section comprise the same polymeric lightweight material.

In another exemplary embodiment, the polymeric, lightweight material is plastic, polycarbonate, rubber, polypropylene or nylon.

In another exemplary embodiment, the polymeric, lightweight material comprising the end section is an elastomer or a foam, and is different from that of the handle section, the middle section and the end cap, or combination thereof.

In another exemplary embodiment, the sixth end of the end section comprises a rounded tip.

In another exemplary embodiment, the sixth end of the end section comprises a button tip.

In another exemplary embodiment, the centrally mounted magnet has a ring-shape and is heatstamped in the end cap.

In another exemplary embodiment, an external surface of the cylindrical handle section comprises a non-slip, gripping surface.

In another exemplary embodiment, the end cap is threadably engaged with the first end of the handle section.

In another exemplary embodiment, the end cap is frictionally engaged with the first end of the handle section.

In another exemplary embodiment, the end cap is hemispherical or cylindrical.

In another exemplary embodiment, the end cap comprises an external knurled surface.

According to an exemplary embodiment of the invention, a metal member is provided in the first end of both the middle and end section of the baton; the metal members engaging the magnet in the end cap to maintain the baton in a collapsed configuration.

In another exemplary embodiment, the present invention relates to an expandable baton for use in self-defense training, comprising: a cylindrical handle section comprising an external surface, first and second ends and an axial bore therethrough, and an end cap comprising a centrally mounted magnet, the end cap removably engaged with the first end of the handle section; a second cylindrical second section comprising a first and second end and disposed within the axial bore of the handle section, and a metal member adapted to engage the centrally mounted magnet at the first end, and an axial bore therethrough, and disposed within the axial bore of the handle section, the second cylindrical section extendable out of, or retractable into the handle section at a second end of the handle section; an end section comprising a first and second end and disposed within the axial bore of the second section, and a metal member adapted to engage the centrally mounted magnet; the end section extendable out of or retractable into the second section; wherein when the baton is extended, the handle section, second section and the end section are frictionally locked in an extended configuration.

It may be an advantage of some exemplary embodiments of the present invention to provide an expandable baton that provides for the same, or substantially similar, carrying, handling, opening and use conditions as a conventional expandable baton currently used in self defense, without the accompanying risk of injury or damage associated with using a conventional or service baton in training scenarios. In the event that a training subject or role player were hit by the baton in a training scenario, injury may be minimized, relative to the effect of a real baton, were it used in a similar situation. The reduced mass of the apparatus, by employing polymeric, lightweight materials in the handle, middle and the end/striking sections, and the absence of a weighted tip section may reduce the risk of injury significantly.

Self-defense training may be employed by various law enforcement officials (e.g. police, sheriff or the like), military, corrections, or security personnel, or those performing a similar role. Use of an expandable baton for self-defense training, officer safety and/or defensive tactics, such as the batons described herein, may provide a user with a realistic experience while mitigating injury potential.

To distinguish an expandable baton used in self-defense training from a conventional service baton, the material used in construction of the expandable baton may be dyed or coloured. For example, conventional batons are black or dark grey, or may be metallic (e.g. silver toned), whereas batons used for training purposes may be coloured blue, red, white or another suitable colour. In some applications, the colour chosen may be specifically indicative of the baton being a device for training purposes only, and may facilitate avoiding confusion of the training device with that of a conventional baton.

This summary of the invention does not necessarily describe all features of the invention. Other aspects, features and advantages of the present invention will become apparent to those of ordinary skill in the art upon review of the following description of specific embodiments of the invention.

BRIEF DESCRIPTION OF THE DRAWINGS

These and other features of the invention will become more apparent from the following description in which reference is made to the appended drawings wherein.

DETAILED DESCRIPTION

Use of examples in the specification, including examples of terms, is for illustrative purposes only and is not intended to limit the scope and meaning of the embodiments of the invention herein. Numeric ranges are inclusive of the numbers defining the range.

Figure 1:
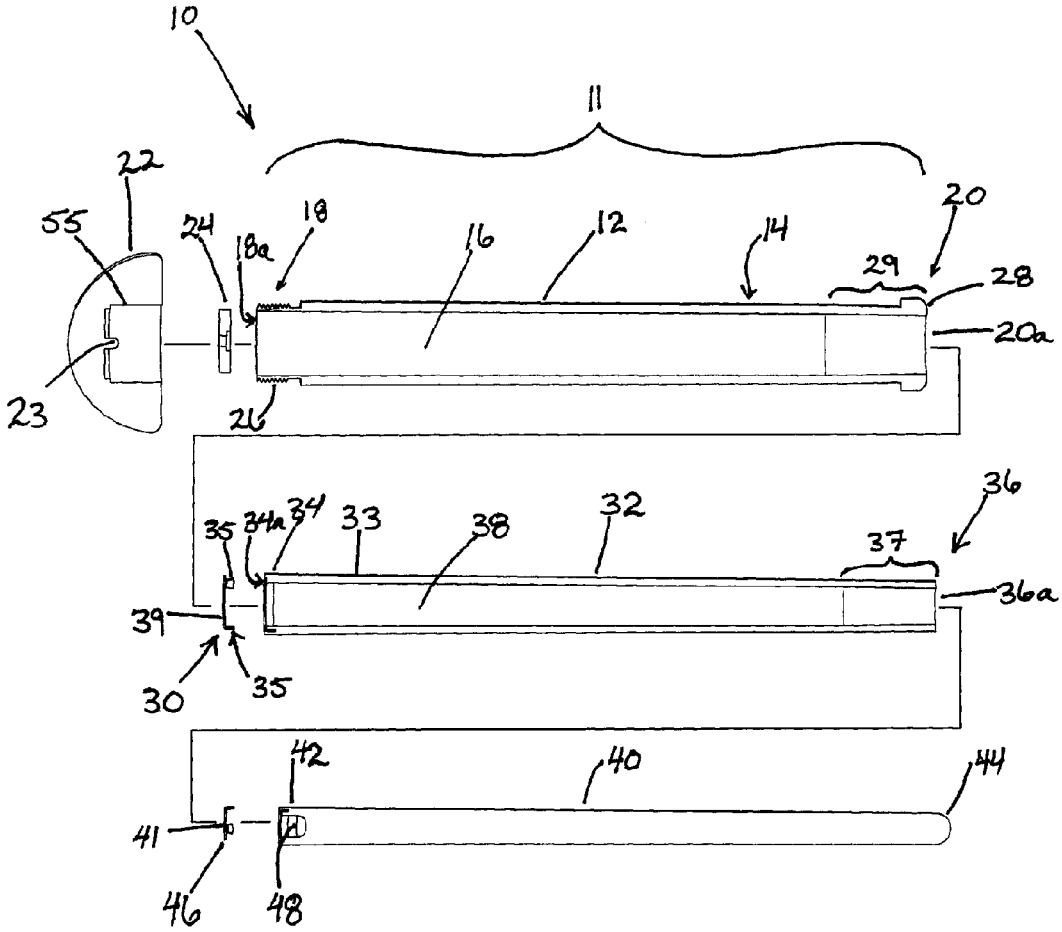
FIG. 1 shows an exploded view of an expandable baton according to an exemplary embodiment of the invention.

Referring to FIG. 1, an exploded view of the expandable baton is shown generally at 10. The baton comprises two or more telescoping sections. In one exemplary embodiment, a handle section 11 (also termed cylindrical handle section) comprises a handle 12 with a cylindrical wall, an external surface 14, a first end 18 and a second end 20. The handle section defines an axial bore 16 with openings 18*a*, 20*a*. The handle 12, in the embodiment illustrated in FIG. 1, has threads 26 at the first end 18 to engage internal threads of an interior surface 55 of an end cap 22. In an alternate embodiment, an end cap is attached to the first end 18 of the handle 12. The end cap may be glued, welded, friction fitted or the like, to the end of the handle.

Figure 4:
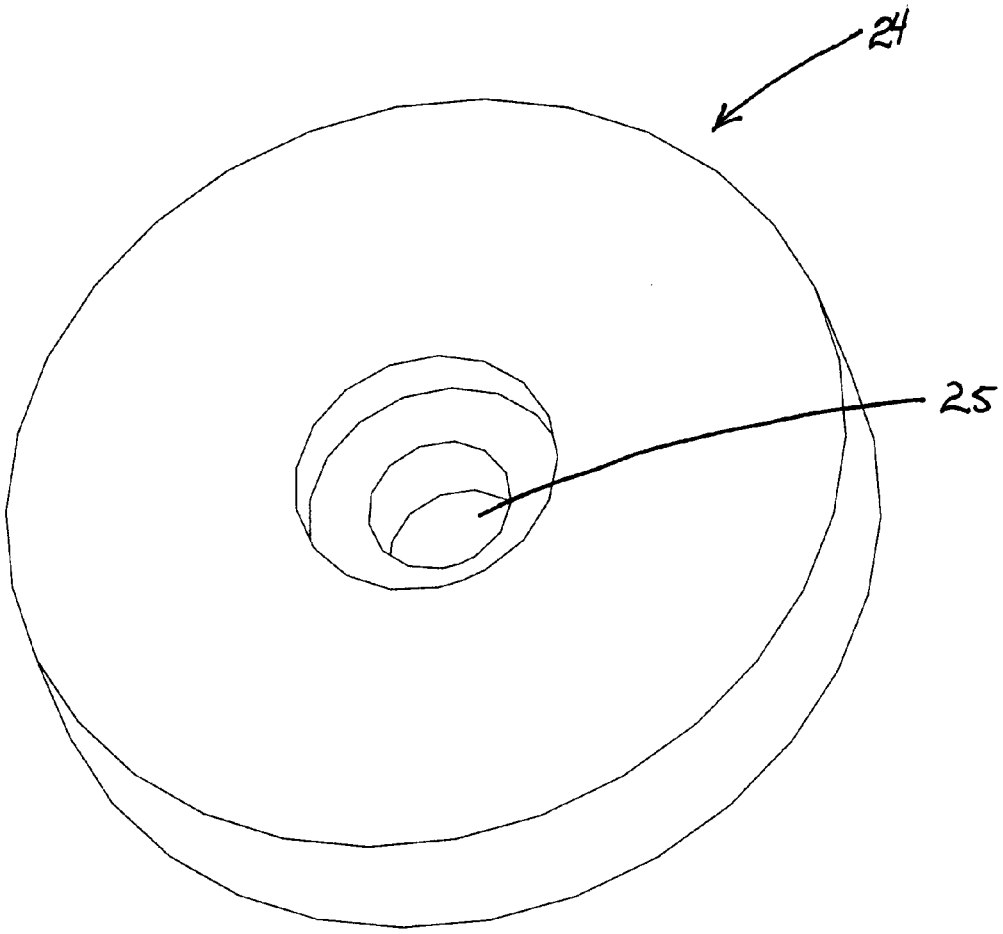
FIG. 4 shows a perspective view of a magnet, according to an exemplary embodiment of the invention.

In embodiments comprising opening 18*a*, the end cap 22 covers opening 18*a* and prevents second section 32 (also termed middle section, or cylindrical middle section) and end section 40 from sliding out of the handle section. Alternately, the first end of the handle 12 may be closed, and the end cap may be optional. The axial bore 16 has an internal diameter sufficient to receive a second section 32 (described below) and the internal diameter is tapered in the region indicated at 29, the internal diameter decreases towards the second end 20 to define opening 20*a* at the second end 20. Opening 20*a* has an internal diameter less than the external diameter of third end 34 of the second section 32. The handle may optionally have a collar 28 that encircles the second end 20 of the handle 12, to retain an optional sleeve (not shown). The sleeve may be a layer, or cylinder, of a resilient non-slip material having an internal diameter slightly greater than an external diameter of the handle 12, and is positioned so as to surround the handle 12 and provide a resilient non-slip surface by which the baton may be gripped during use. The gripping surface may be made of, for example, synthetic rubber, foamed vinyl, or other suitable material offering a resilient and/or no-slip surface. Alternately, the handle may have a textured surface, e.g. a knurled surface, The end cap 22, when engaged with the first end of the handle, prevents the sleeve from sliding off the handle at the first end. The end cap 22 may be removed to position or remove the sleeve, or to exchange an end section 40 (see below) of a first material with an end section of a second material, to provide a striking section (the end section) having suitable flexibility or rigidity as described below. A magnet 24 is centrally fixed to the inside of the end cap 22. In one exemplary embodiment, the magnet may be ring-shaped (FIG. 4), having a central opening 25 to accommodate a stub 23 of material that is melted when the magnet is heatstamped or heat molded into the end cap 22. In another exemplary embodiment, the magnet may be centrally fixed to the inside of the end cap by an adhesive, or retained by a lip, tab or screw, or it may be press fitted, or by other suitable attachment methods. In an embodiment where the first end of the handle section is closed, the magnet may be fixed to an end surface of the first end.

Handle section 12, second section 32, end section 40 and end cap 22 may be formed from an appropriate thermoplastic lightweight material, for example plastic, nylon, polyethylene, polycarbonate, synthetic rubber or other thermoplastic polymers. In some exemplary embodiments, the material may be suitable for injection molding, and the components of the baton formed by injection molding. The material is selected to be lightweight, provide sufficient rigidity to allow for manipulation of the baton during training (e.g. removal and replacement of the baton in the holster or holder, extension and collapse of the baton for use and the like).

Figure 5:
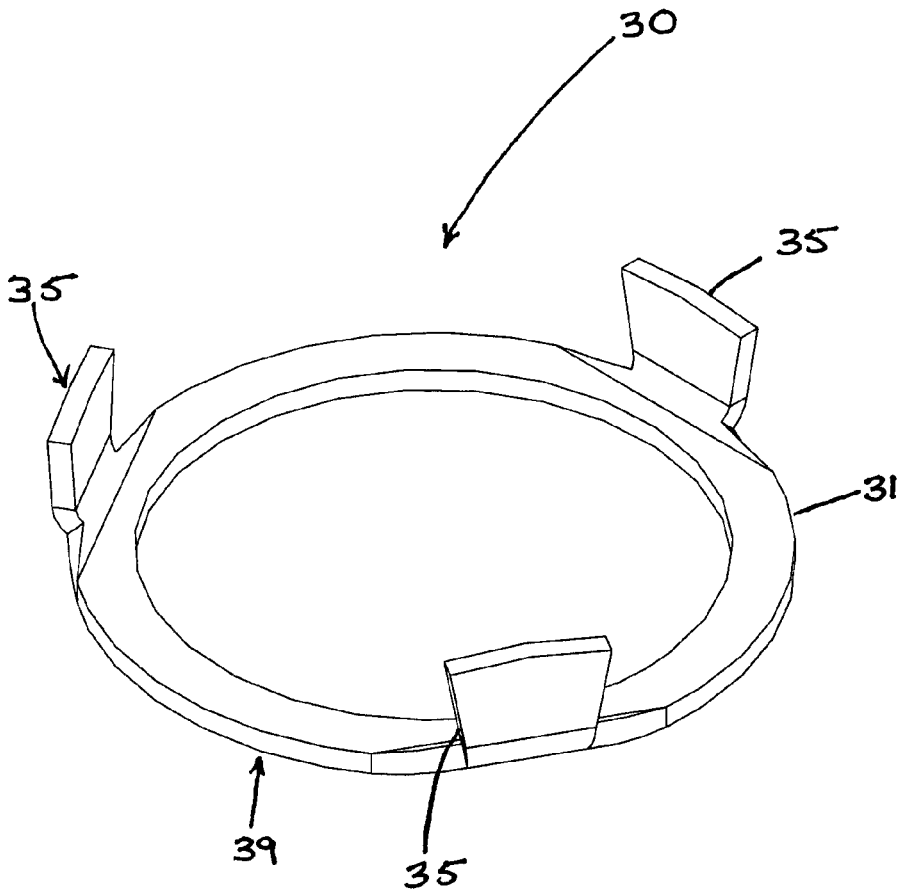
FIG. 5 shows a perspective view of a metal member, according to an exemplary embodiment of the invention.

Second section 32 (also referred to as second cylindrical section, or middle section) is cylindrical or substantially cylindrical and comprises a cylindrical wall, an external surface 33, a third end 34 and a fourth end 36. The second section defines an axial bore 38 with openings 34*a*, 36*a*. The second section 32 has an external diameter slightly less than axial bore 16 of the handle section 12 so that second section 32 can fit within axial bore 16 of the handle section. The external diameter of the third end 34 is flared slightly to allow the external surface 33 of the middle section to frictionally engage the taper 29 of the handle section when the baton is extended (below). The axial bore 38 has an internal diameter sufficient to receive an end section 40 (described below). The internal diameter tapered in the region indicated at 37, decreases towards the fourth end 36 to define an opening 36*a* at the fourth end 36 having an internal diameter less than the external diameter of a fifth end 42 of the end section 40. A metal member 30 (also see FIG. 5) comprising a ring 31 (FIG. 5) and claws or tabs 35 is set into the third end 34 . The ring 39 magnetically engages magnet 24 when the baton is in the collapsed configuration (see FIG. 2).

Figure 2:
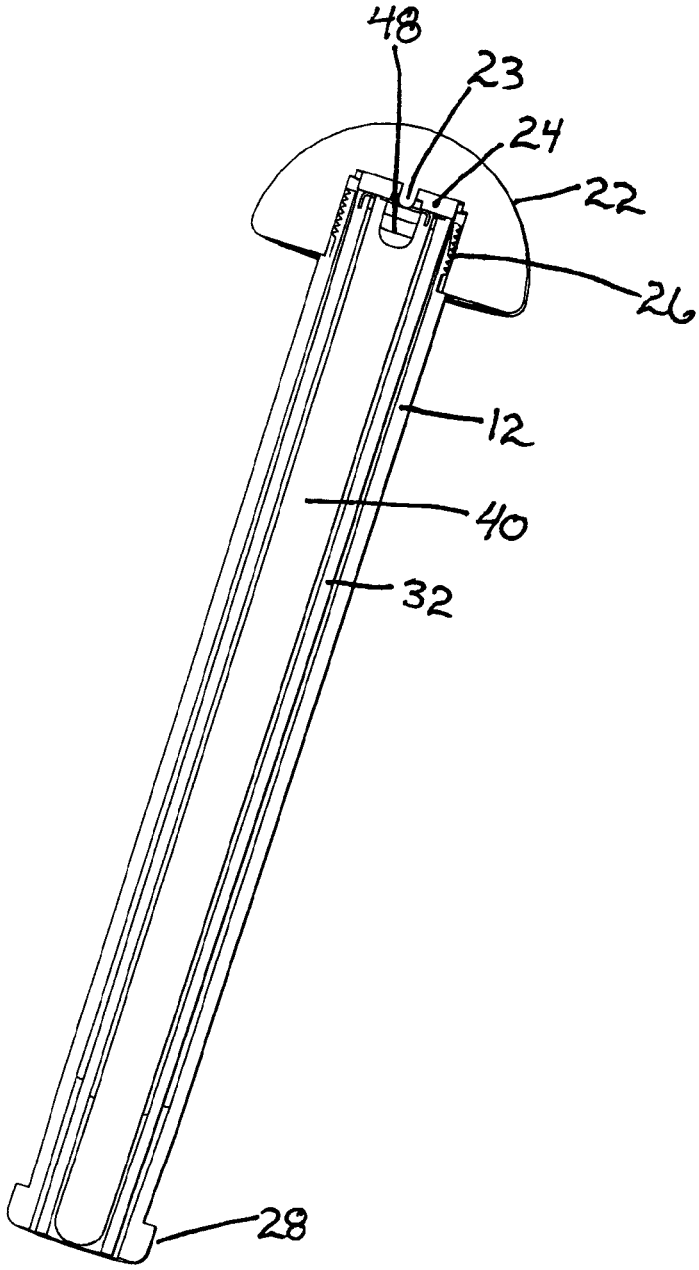
FIG. 2 shows a side elevation view of an expandable baton in a collapsed or retracted state, according to an exemplary embodiment of the invention.
Figure 3:
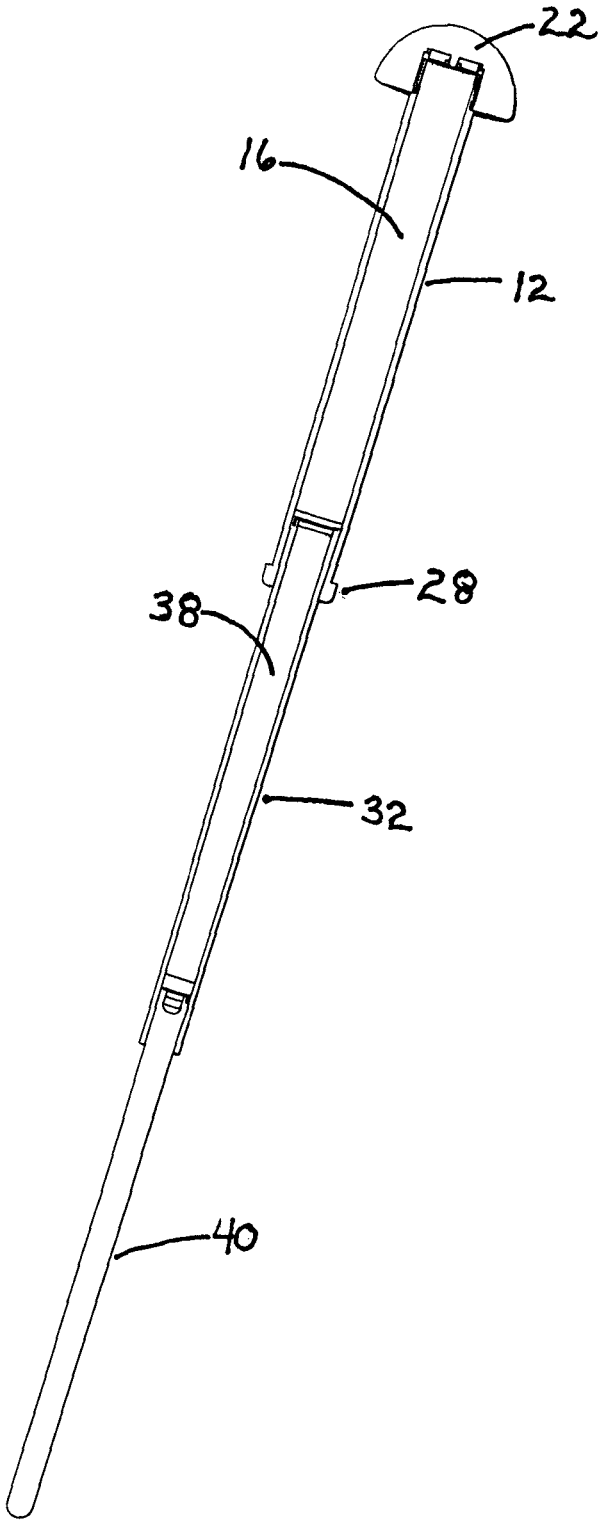
FIG. 3 shows a side elevation view of an expandable baton in the expanded state, according to an exemplary embodiment of the invention.

End section 40 is cylindrical, comprising a fifth end 42 and a sixth end 44. The end section 40 has an external diameter slightly less than the axial bore 38 of the second section 32 so that the end section 30 can fit within axial bore 38; the external diameter is flared slightly towards the fifth end so as to frictionally engage the taper 37 of the second section when the baton is extended (described below). A second metal member 46 comprising a ring and claws configured in the manner of metal member 30 is set into the fifth end 42, and configured so that ring surface 41 magnetically engages the magnet 24 when the baton is in the collapsed configuration. In the illustrated, exemplary embodiment, a blind bore, or recess, 48 in the fifth end 42 accommodates stub 23 when the baton is in the collapsed configuration (FIG. 2). The sixth end 44 may be rounded, or in some embodiments, comprise a button or knob. The button or knob may be molded as one piece with the end section, or may be removably attached. In some exemplary embodiments, the end section may be hollow, or partially hollow, or solid.

The angle of the taper 29 and the external diameter of the second section 32, and the angle of the taper 37 and the external diameter of the end section 40 are set to define a telescoping joint (may be described as a deadlock taper joint) for frictionally locking the telescoping sections in the extended position when the baton is grasped in a user's hand and the baton 'flicked' or 'whipped' open to a fully extended position. A flared region of the second section 32 near the third end 34 engages the taper 29, and a flared region of the end section 40 near the fifth end 42 engages the taper 37 to maintain the baton in the extended position. The baton can be readily retracted, as described below.

Figure 7:
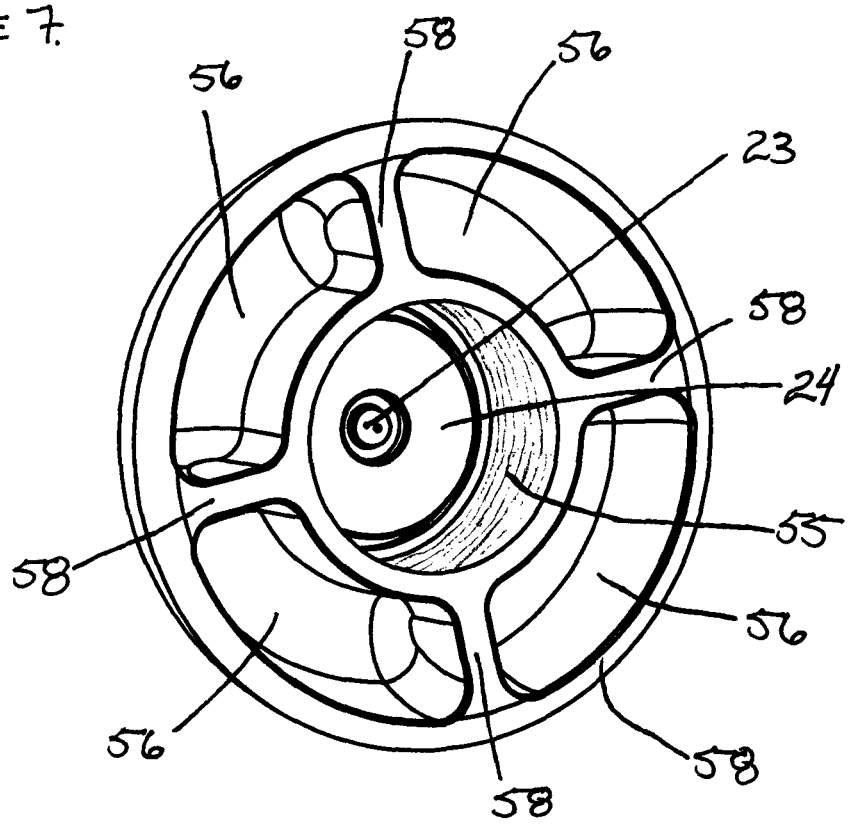
FIG. 7 shows two perspective views of an end cap according to an exemplary embodiment of the invention.
Figure 7:
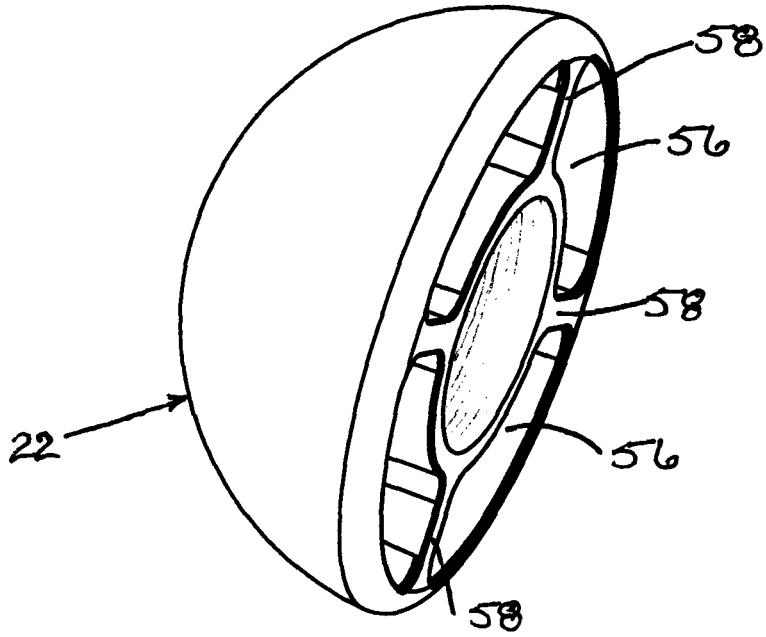
Figure 8:
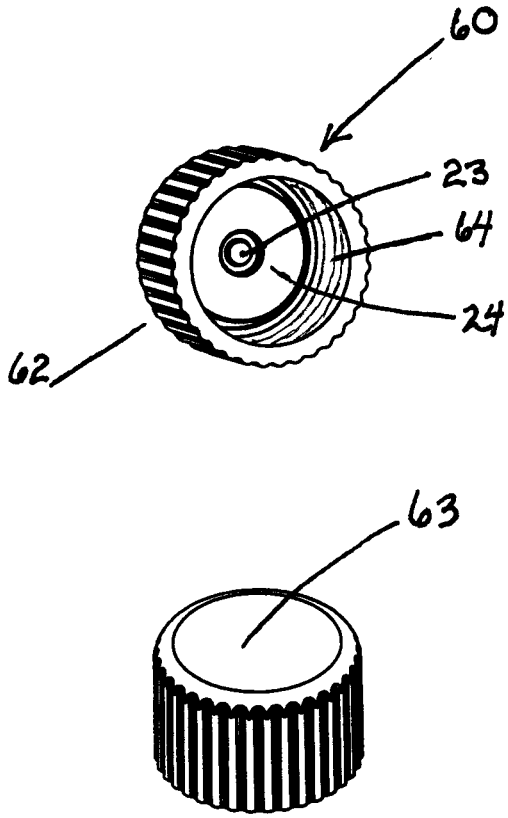
FIG. 8 shows two perspective views of an end cap according to an exemplary embodiment of the invention.

FIGS. 7 and 8 show enlarged perspective views of two examples of end caps. FIG. 7 illustrates the hemispherical end cap 22 (e.g. a "Hindi Baton Cap™"). The interior surface 55 of the end cap optionally includes threads to engage the threads 26 at the first end 18 of the handle section 12. The interior 56 of the end cap may be hollow to reduce mass and material, with members 58 providing structural support for the internal wall 55 and exterior wall 58. FIG. 8 illustrates a flat end cap 60 comprising an exterior surface 62, a flat end 63 and a threaded interior surface 64. As for the hemispherical end cap 22, the threads on the interior surface 64 engage the threads 26 at the first end 18 of the handle section 12. Optionally, the external surface 62 may be textured, or knurled. In the exemplary embodiments shown in both FIGS. 7 and 8, the magnet 24 is shown in a ring-shaped embodiment held in position by the stub 23. Other variants of end caps will be apparent to those of skill in the art, examples can include end caps comprising rings or hooks, wrist straps or the like. In some embodiments of the invention, the end cap may be modified to further comprise a light or an aerosol dispersion device, to provide a composite baton.

To extend or open the baton (e.g. extending the second section and end section out from the handle section), the baton is drawn from the holster or carrier and whipped open using a swinging or flicking action. Conventional expandable batons used in law enforcement, even lightweight ones, are designed to focus the mass of the baton in the end section (or in some devices, the tip) to maintain impact force and additionally facilitate this opening action.

To collapse the baton (e.g. retract the second section and end section into the handle), the end section 40 and the second section 32 are grasped and twisted approximately a one-quarter turn in opposing directions to release the friction lock or 'deadlock'. A similar grasp-and-twist is applied to the second section and handle section to complete the collapse. Closing the baton in this manner may provide a further advantage of allowing the user to emulate the closing of a baton having a 'Lever-Lock' action (e.g. batons manufactured by Armament Systems and Procedures, described in, for example U.S. Pat. No. 7,416,490) and complete the training scenario using the same motions and actions as would occur in a real situation.

An alternate method of closing the baton comprises a sharp axial blow on a hard object (e.g. pavement or a concrete wall) sufficient to release the deadlock joint and collapse the baton. If a rigid material is used in construction of the baton sections, this method may be suitable, however if softer or more flexible materials are used for the end section (described below), the grasp-and-twist method may be preferable.

In some embodiments, the end section 40 may be formed of the same material as the handle and second sections, with the entire baton demonstrating similar rigidity across the sections. In some alternate embodiments, the end section may be formed of a softer/more flexible material than that used for the handle and second sections. For example, the material may be ethylene-vinyl acetate (EVA) copolymer or foam, rubber, synthetic rubber or foam rubber, or another suitable elastomer. Examples of EVA material include those known commercially as LEVIREX™. Use of a softer and/or more flexible material such as EVA or rubber provides further safety in training situations—while a training subject would be armored appropriately, in the event that the subject is inadvertently struck in an unprotected area, the chance of injury may be significantly reduced or eliminated.

Figure 6:
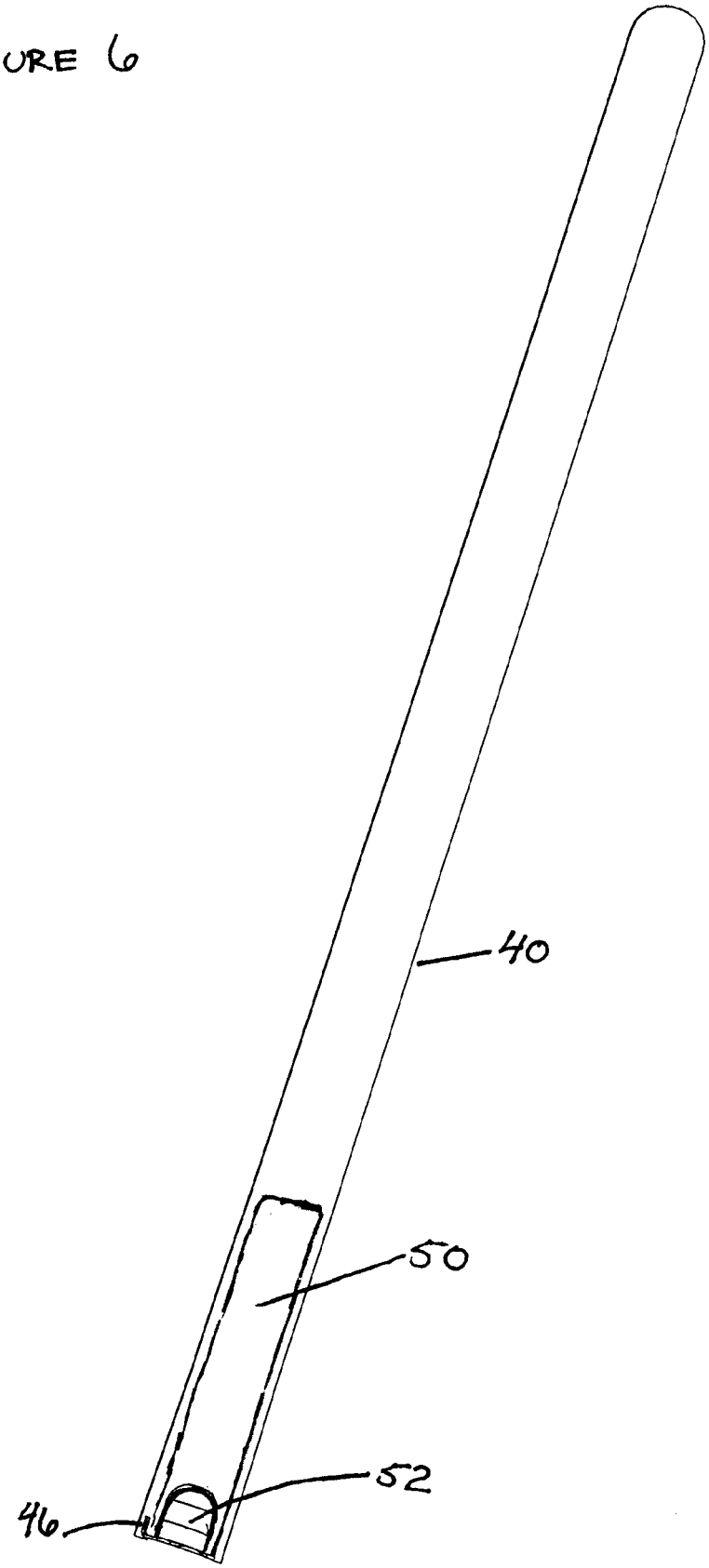
FIG. 6 shows a side elevation view of an end section of the baton, comprising a rigid core, according to an exemplary embodiment of the invention.

As EVA, rubber or other similar softer or more flexible materials may become compressed when the baton is extended, a rigid core (e.g. metal, plastic, polyethylene, polypropylene, nylon or the like) may be included in the end section to provide for sufficient rigidity to enable the deadlock taper to maintain the extended configuration. As is shown in FIG. 6, a core 50 is located at the fifth end 42 of the end section 40. The metal member 46 is embedded in the core 50, and a blind bore 52 (if present) in the core 50 accommodates the stub 23 when the baton is in a collapsed configuration.

The expandable baton may also be useful for self-defense training scenarios that may involve combat in or near bodies of water. The expandable baton according to various embodiments of the invention comprises materials that absorb minimal to no water, and thus do not undergo a substantial change in mass if used in water, or if it gets wet. In some embodiments, the baton may float, or material applied to the handle for an improved gripping surface may provide floatation, making retrieval of a dropped baton easier.

Expandable batons according to various embodiments of the invention may fit and be carried in, or with, a conventional baton holster or scabbard. Examples of such holsters or scabbards include a side-break holster (e.g. those provided by Armament Systems and Procedures Inc.)

Batons may be constructed in a range of sizes—for example, ranging from about 16 to about 36 inches, or any amount therebetween, or more depending on the intended use and a user's preference.

Expandable batons may be constructed by a casting or injection molding process, such as are known in the art. For example, U.S. Pat. No. 5,690,552 discloses an injection molding process to produce the handle, second and end sections in one mold as a single step. It will be apparent to those of skill in the art that this, or similar methods may be used; alternately, if an end section of a different material from that of the handle and second sections are desired, that this end section may be cast or injection-molded separately.

Other embodiments

The expandable baton according to various embodiments of the invention may be provided as part of a kit, the kit comprising one or more batons, along with instructions for use, or other materials suitable for education or training purposes. The kit may further comprise multiple end sections, each comprised of various materials, e.g. nylon or polycarbonate for a more rigid end section, EVA, foam, foam rubber or rubber for a more flexible end section that may be interchanged for user preference, or suitability to the training scenario.

All citations are herein incorporated by reference, as if each individual publication was specifically and individually indicated to be incorporated by reference herein and as though it were fully set forth herein. Citation of references herein is not to be construed nor considered as an admission that such references are prior art to the present invention.

One or more exemplary embodiments of the invention have been described by way of example. The invention includes all embodiments, modifications and variations substantially as hereinbefore described and with reference to the examples and figures. It will be apparent to persons skilled in the art that a number of variations and modifications can be made without departing from the scope of the invention as defined in the claims. Examples of such modifications include the substitution of known equivalents for any aspect of the invention in order to achieve the same result in substantially the same way.

What is claimed is:

1. A expandable baton, comprising:

a cylindrical handle section comprising a first end, a second end and an axial bore therethrough, and an end cap removably engaged with the first end of the handle section, the end cap comprising a centrally mounted magnet;

a cylindrical middle-section comprising a third end and a fourth end, and an axial bore therethrough, and a first metal member located at the third end for engaging the centrally mounted magnet, and disposed within the axial bore of the cylindrical handle section, the middle section slidably engaged within the second end of the cylindrical handle section;

an end-section comprising a fifth end and a sixth end, the end-section disposed within the axial bore of the middle-section, the end-section comprising a second metal member located at the fifth end for engaging the centrally mounted magnet, the end-section slideably engaged within the middle-section;

wherein when the expandable baton is extended, the cylindrical handle section, the middle-section and the end section frictionally engage in an extended configuration, and wherein the handle section, middle section and end section comprise a lightweight, polymeric material.

2. The expandable baton of claim 1, wherein the handle section, end cap, second section and end section comprise the same polymeric lightweight material.

3. The expandable baton of claim 1, wherein the polymeric, lightweight material is plastic, polycarbonate, rubber, polypropylene or nylon.

4. The expandable baton of claim 1, wherein the polymeric, lightweight material comprising the end section is an elastomer or a foam.

5. The expandable baton of claim 1, wherein the sixth end of said end section comprises a rounded tip.

6. The expandable baton of claim 1, wherein the sixth end of the end section comprises a button tip.

7. The expandable baton of claim 1, wherein the centrally mounted magnet has a ring-shape and is heatstamped in the end cap.

8. The expandable baton of claim 1, wherein an external surface of the cylindrical handle section comprises a non-slip, gripping surface.

9. The expandable baton of claim 1, wherein the end cap is threadably engaged with the first end of the handle section.

10. The expandable baton of claim 1, wherein the end cap is frictionally engaged with the first end of the handle section.

11. The expandable baton of claim 1, wherein the end cap is hemispherical or cylindrical.

12. The expandable baton of claim 1, wherein the end cap comprises an external knurled surface.

* * * * *